United States Patent [19]

Cusmano

[11] Patent Number: 4,531,637

[45] Date of Patent: Jul. 30, 1985

[54] PACKAGE SHAPED TO HANG OR STAND ON END

[75] Inventor: James A. Cusmano, Gladstone, N.J.

[73] Assignee: Plastofilm Industries, Inc., Wheaton, Ill.

[21] Appl. No.: 583,248

[22] Filed: Feb. 24, 1984

[51] Int. Cl.[3] ..... B65D 73/00; B65D 75/00

[52] U.S. Cl. ..... 206/461; 206/464; 206/467; 206/468; 206/806; 248/152

[58] Field of Search ..... 206/461, 462, 464, 467, 206/468, 471, 806; 229/41 B; 248/152, 174

[56] References Cited

U.S. PATENT DOCUMENTS

| | | | |
|---|---|---|---|
| 2,159,823 | 5/1939 | Snelling | 248/174 |
| 2,949,185 | 8/1960 | Foote et al. | 206/477 |
| 3,093,244 | 6/1963 | Middleton, Jr. et al. | 206/461 |
| 3,239,177 | 3/1966 | Samsing | 248/174 |
| 3,407,928 | 10/1968 | Watts, Jr. | 206/462 |
| 3,685,649 | 8/1972 | Diehl | 206/462 |
| 3,985,232 | 10/1976 | Johnson | 206/461 |
| 4,133,429 | 1/1979 | Kuchenbecker | 206/468 |
| 4,171,050 | 10/1979 | Murray et al. | 206/471 |
| 4,234,084 | 11/1980 | Hutten | 206/484 |
| 4,422,551 | 12/1983 | Pawlowski | 206/461 |

*Primary Examiner*—William T. Dixson, Jr.
*Assistant Examiner*—Brenda J. Ehrhardt
*Attorney, Agent, or Firm*—Lee, Smith & Zickert

[57] ABSTRACT

A package suitable for either hanging or standing on end. The package includes a blister portion having a receptacle with a substantially flat, open back which is usually closed by a thin strip in the final assembly, a top flange extending upwardly from the receptacle at the open back and a bottom flange extending downwardly from the receptacle at the open back. A carrier portion is joined to the blister portion and includes a flat rear panel abutting the open back. The blister portion is attached to the carrier portion by means of a flap in the rear panel securing the top flange to the rear panel and a band formed in the bottom of the carrier portion extending outwardly from the rear panel about a retention element protruding downwardly from the bottom of the receptacle. The band and the bottom flange in combination comprise a rest for supporting the package on end on a horizontal surface.

14 Claims, 3 Drawing Figures

PACKAGE SHAPED TO HANG OR STAND ON END

BACKGROUND OF THE INVENTION

This invention relates to packages and in particular to a blister-type package which has its blister portion independently sealed and which is suitable for hanging or standing on end to display its contents.

Blister-type packages are commonly used for packaging small articles for display purposes prior to sale. A typical blister package has a plastic blister or bubble blister which is secured to a cardboard carrier, known as a display card, which carries a description of the product, instructions and other information desired or required for sale of the packaged item. If the package has a flat bottom, it will stand on end. Usually, however, because of a flange formed about the periphery of the blister portion in order to permit securing of the blister portion to the cardboard carrier, the bottom is not flat and the blister package is provided with a hole near the top of the carrier for suspending the package from a display rod in a store fixture.

SUMMARY OF THE INVENTION

The invention relates to a package which is suitable both for hanging or standing on end. The package includes two primary components, a blister or container portion and a carrier portion. The blister portion includes a receptacle having a closed bottom and a substantially flat, open back, a top flange extending upwardly from the receptacle at the open back, and a bottom flange extending downwardly from the receptacle at the open back. The bottiom flange further comprises a rear support for the completed package to assist standing the package on end. A retention element is formed in the closed bottom of the receptacle, spaced from the bottom flange. The carrier portion is joined to the blister portion and includes a flat rear panel abutting the open back. To attach the blister portion to the carrier portion, the invention includes means in the rear panel for securing the top flange to the rear panel, and receiving means in the carrier portion for engaging and holding the retention element, with the receiving means further comprising a front support for the package. Together, the receiving means and the bottom flange comprise a rest for supporting the package on end on a horizontal surface.

In accordance with the preferred embodiment of the invention, the blister portion is plastic and is formed in such a manner that only the back is open. The back of the blister is pre-sealed by a thin strip of plastic, paper or the like which is either heat-sealed or adhesively secured to the receptacle to cover the open back. Since the blister is pre-sealed, it is self-contained and need not be immediately mounted in the carrier portion.

The receptacle includes a pair of side flanges each extending outwardly from the receptacle at the open back. The top, side and bottom flanges together comprise a continuous flange about the periphery of the open back.

A pair of side panels is attached to the rear panel of the carrier portion, each panel being adjacent to one side of the blister portion to retain the blister portion between the side panels. The attachment means and side panels in combination securely retain the blister portion on the carrier portion. In addition, the blister can be secured to the carrier in a typical manner, such as by heat sealing the blister portion along those portions of its flanges in contact with the rear panel, although such sealing is normally unnecessary since the blister is pre-sealed.

The retention element comprises a protrusion extending outwardly and downwardly from the closed bottom. The protrusion has a front wall extending orthogonally to the closed bottom and spaced from the bottom flange and which is engaged by the receiving means. The receiving means comprises a band formed in the bottom of the carrier which extends outwardly in a triangular fashion from the rear panel about the protrusion. Normally, the band is formed such that it extends from portions of the bottoms of the side panels.

The top flange is secured to the rear panel by means of a flap beneath which the top flange is inserted. The top flange therefore is sandwiched between the flap and the rear panel. Although the band and the bottom flange together form a rest or a stand for self-supporting the package on end on a horizontal surface, in order to permit the package to be hung from a store display, the package includes a hole in the rear panel near the top thereof.

BRIEF DESCRIPTION OF THE DRAWINGS

The invention is described in greater detail in the following description of the preferred embodiment, taken in conjunction with the drawings, in which.

DESCRIPTION OF THE PREFERRED EMBODIMENT

Figure 1:
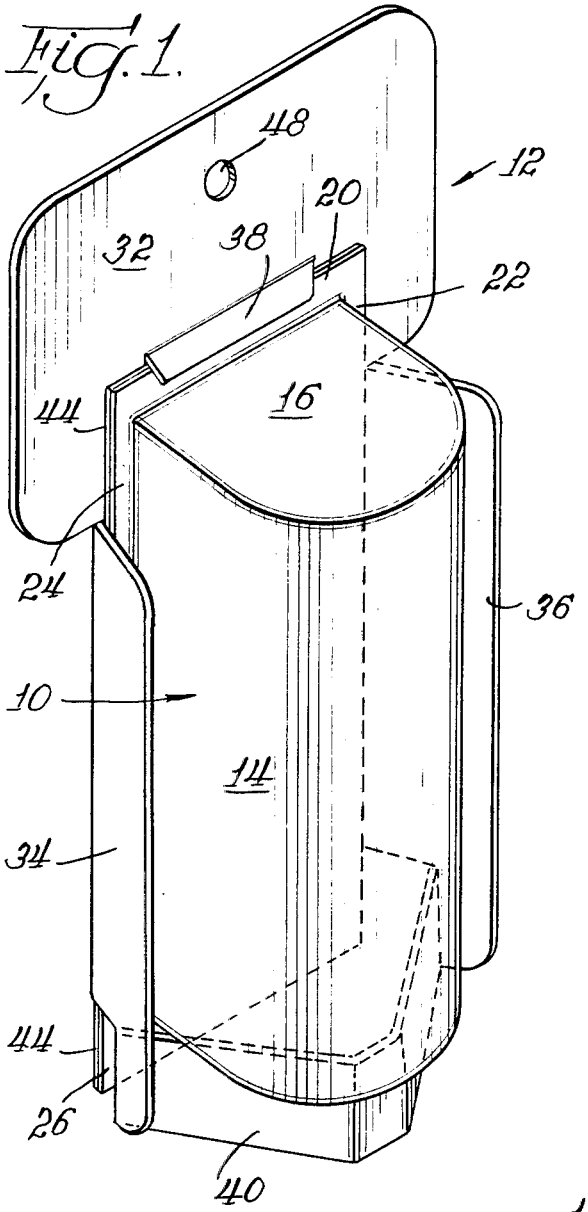
FIG. 1 is a perspective view of a package according to the invention.

A package in accordance with the invention is shown in the three drawings figures and is composed of two primary elements, a blister portion 10 and carrier portion 12. As described in greater detail below, the blister portion 10 and carrier portion 12 cooperate to form a package which is suitable either for hanging or standing on its bottom end.

The blister portion 10 is composed of a receptacle 14 which has a flat back abutting the carrier portion 12 and which is open at its back. The remainder of the receptacle 14 is closed, including its top 16 and bottom 18. A flange extends about the periphery of the open back of the receptacle 14 and includes four flange portions, a top flange 20 extending upwardly from the receptacle 14, two side flanges 22 and 24 extending outwardly from the receptacle 14, and a bottom flange 26 extending downwardly from the receptacle 14 at its open back.

Figure 3:
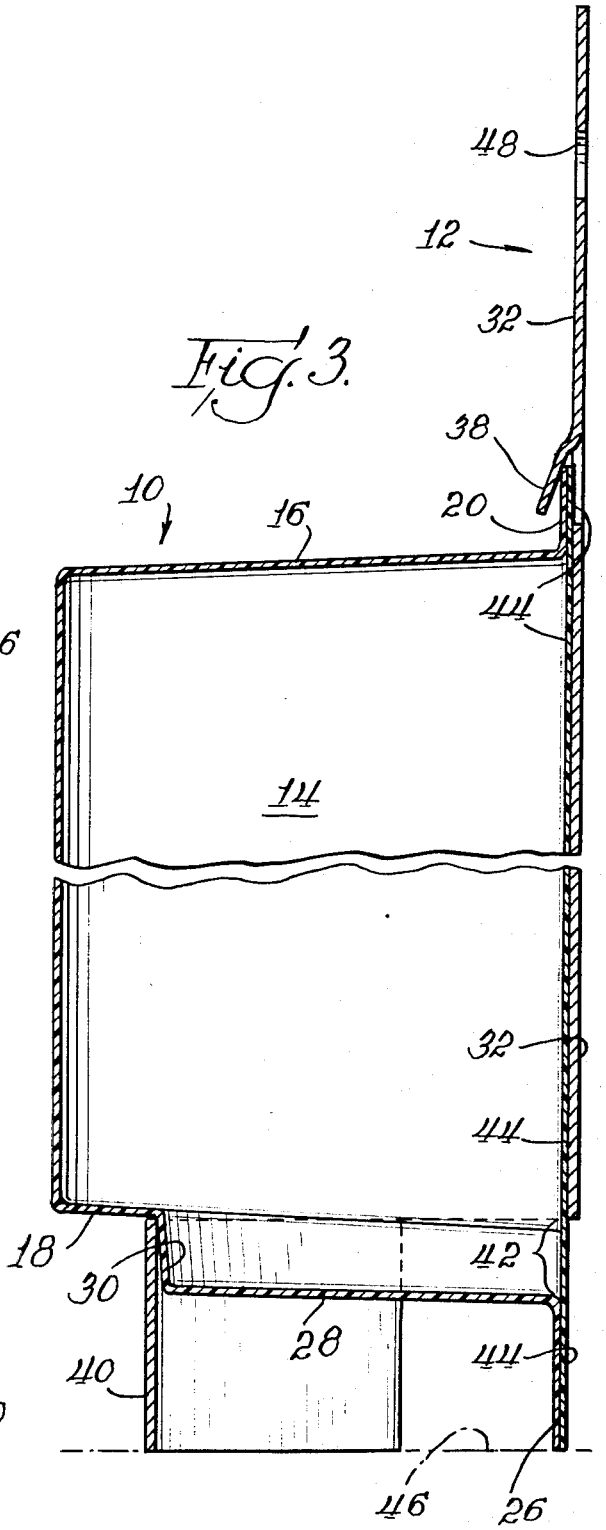
FIG. 3 is an enlarged cross-sectional illustration taken along lines 3—3 of FIG. 2 which is fore-shortened by having the redundant center portion broken away as illustrated.
Figure 2:
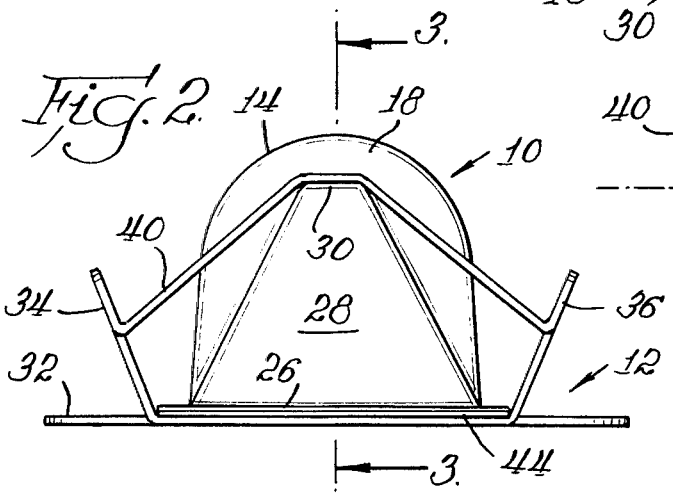
FIG. 2 is an enlarged bottom plan view of the package of FIG. 1 illustrating the attachment of the blister portion to the carrier portion.

The bottom 18 of the receptacle 14 includes a protrusion 28 extending outwardly and downwardly from the bottom 18 as best shown in FIGS. 2 and 3. The protrusion 28 includes a substantially flat front wall 30 which extends orthogonally to the bottom 18 and, as shown, is spaced forwardly from the bottom flange 26. The protrusion 28 and its front wall 30 are used in combination with the carrier portion 12 to secure the blister portion 10 to the carrier portion 12, as described in further detail below.

The carrier portion 12 has a flat rear panel 32 abutting the open back of the blister portion 10. Integral side panels 34 and 36 extend at an oblique angle to the rear panel 32 on opposite sides of the flanges 22 and 24 of the receptacle 14 in order to retain the blister portion 10 between the side panels 34 and 36. Typically, the carrier portion 12 is die cut from cardboard or a similar material and the side panels 34 and 36 are cut and bent from the material of the carrier portion 12 into the form shown in the drawing figures.

While the side panels 34 and 36 hold the blister portion 10 laterally in place, the side panels 34 and 36 do not attach the blister portion 10 to the carrier portion 12. Attachment is by means of a flap 38 formed in the rear panel 32 for securing the top flange 20 to the rear panel 32 and by means of a band 40 extending outwardly from the carrier portion 12 for engaging and holding the protrusion 28. Similar to the side panels 34 and 36, the band 40 is integrally formed from the material of the carrier portion 12 and, as shown in FIGS. 1 and 2, extends from the side panels 34 and 36 around the front wall 30 of the protrusion 28 in essentially a triangular configuration.

As most clearly shown in FIG. 3, since the band 40 is formed from the material of the carrier portion 12, due to the geometry of the various elements of the carrier portion 12 and blister portion 10, when assembled as shown, a gap 42 exists between the bottom of the rear panel 32 and the protrusion 28. While such a gap may not be objectionable if a large article or series of large articles are to be contained within the receptacle 14, normally the rear of the receptacle 14 is sealed with a thin strip 44 which is of plastic, paper or the like and which is either heat-sealed or adhesively secured to the flanges 20, 22, 24 and 26 of the receptacle 14. The strip 44 is applied to the blister portion before the blister portion 10 is installed on the carrier portion 12. Thus, the blister portion is self-contained and does not depend on the carrier portion 12 to retain goods within the receptacle 14.

As best shown in FIG. 3, the band 40 forms a triangular front support for the package when situated on a flat surface 46. Similarly, the bottom flange 26 forms a rear support for the package, as shown. Thus, the band 40 and bottom flange 26 in combination form a rest or base for supporting the package on end on the horizontal surface 46. Necessarily, in order for the package to stand, the depth of the band 40 must substantially equal the depth of the front wall 30 plus the depth of the bottom flange 26, so long as the bottom of the protrusion 28 is substantially horizontal. The relative dimensions of the flange 26 and band 40 will be evident given the prerequisite that when the package is placed on a horizontal surface 46, the rear panel 32 must be generally vertical to avoid tipping of the package.

For hanging of the package, the rear panel 32 includes a hole 48 near the top thereof. If desired, the hole 48 can be eliminated or, if required, a different type of hanging element can be employed for proper suspension of the package of the invention.

Although the protrusion 28 has been illustrated as a trapezoidal extension of the bottom 18 of the blister portion 10, it should be evident that the protrusion 28 may take on a myriad of shapes so long as a part of the protrusion 28 equivalent to the front wall 30 is situated substantially in the position of the front wall 30 such that the band 40 extends outwardly sufficiently from the rear panel 32 to adequately support the package of the invention. Thus, the protrusion 28 may be merely a rod extending downwardly in the place of the front wall 30, or may be otherwise shaped. Since the blister portion 10 is typically of plastic and is most expeditiously formed in a thermo-forming process, mold requirements demand that the protrusion 28 extend from the front wall 30 to the open back of the receptacle 14 in order to allow the formed blister portion to be withdrawn from the mold. Other than such practical considerations, however, it should be evident that any number of configurations for the protrusion 28 will serve the purpose of maintaining the band 40 in the position illustrated in the drawings.

All elements of the carrier portion 12 are preferably formed from a single blank of material which is die cut and bent into the form shown in the drawings. Thus, necessarily, formation of the band 40 requires that the gap 42 appear in the finished product. If desired, however, the various elements of the carrier portion 12 can, rather than integral, be formed separately and be adhesively secured to the rear panel 32. Although such formation is considerably more expensive, the elements of the carrier 12 can be formed such that the rear panel 32 is of a sufficient dimension to avoid the gap 42. As explained above, however, since the blister portion 10 is preferably a thermoformed plastic, and since the carrier 12 is formed from a single blank of material, geometrical considerations require that the gap 42 exist.

Although not necessary since the strip 44 is applied to the open back of the receptacle 14, if desired, the carrier portion 12 and blister portion 10 can be sealed to one another along the flanges 20, 22, and 24 in a conventional manner. The means of sealing, if used, is well known and forms no part of the invention.

The blister portion 10 is illustrated in a vertically elongated fashion. It should be evident that the geometry of the blister portion 10 and the carrier 12 can be changed so that the blister portion 10 is essentially square (thus not elongated in any direction) or the blister portion 10 can be formed such that it is wider than it is tall. The shape of the blister portion 10 is dictated by the needs of the user.

Various changes can be made to the invention without departing from the spirit thereof or scope of the following claims.

What is claimed is:

1. A vertically elongated package suitable for handing or standing on end, comprising a. a blister portion including a receptacle having a closed bottom, front and sides, and a substantially flat, open back, b. a top flange extending upwardly from said receptacle at said back, c. a bottom flange extending downwardly from the bottom of said receptacle at said back, said bottom flange comprising a rear support for use in standing said package on end, d. a retention element disposed in the bottom of said receptacle and spaced forwardly from said bottom flange, e. a carrier portion joined to said blister portion and including a flat rear panel abutting said open back, said carrier portion being disposed vertically and having a bottom and a top, and f. means for removably mounting said blister portion upon said carrier portion, comprising i. flap means formed in said rear panel for securing thereunder said top flange to said rear panel, and ii. receiving means in said carrier portion at the bottom of said carrier portion for engaging and holding said retention element and thus said blister portion against said rear panel, said receiving means further comprising a front support for use in standing said package on end and extending outwardly from said bottom flange beneath the bottom of said receptacle when said blister portion is mounted upon said carrier portion, iii. said flap means being situated in said rear panel such that when said blister portion is mounted on said carrier portion, said top flange is secured to said panel by said flap means and said bottom flange is situated at the bottom of said carrier portion, g. said receiving means and said bottom flange of said blister portion in combination comprising a rest for supporting said package on end on a horizontal surface.

2. A package according to claim 1 including a resilient strip secured to said receptacle to cover said open back.

3. A package according to claim 2 in which said strip is heat-sealed to said receptacle.

4. A package according to claim 2 in which said strip is adhesively secured to said receptacle.

5. A package according to claim 1 including a pair of side panels attached to said rear panel, each said side panel being adjacent one side of said blister portion to retain said blister portion between said side panels.

6. A package according to claim 1 including a pair of side flanges each extending outwardly from said receptacle at said back, said top flange, side flanges and bottom flange together comprising a continuous flange about the periphery of said open back.

7. A package according to claim 1 in which said retention element comprises a protrusion extending outwardly and downwardly from said closed bottom, said protrusion having a front wall extending orthogonal to said closed bottom and spaced forwardly from said bottom flange and being engaged by said receiving means.

8. A package according to claim 1 in which said means for securing comprises a flap hinged along its top edge to open and receive said top flange between said flap and said rear panel.

9. A package according to claim 8 in which said flap in an integral part of said rear panel.

10. A package according to claim 1 in which said receiving means comprises a band formed from the bottom of said carrier portion and extending outwardly from said rear panel about said retention element.

11. A package according to claim 1 in which said retention element comprises a protrusion extending outwardly and downwardly from said closed bottom and in which said receiving means comprises a band formed in the bottom of said carrier portion and extending outwardly fronm said rear panel about said protrusion.

12. A package according to claim 1 including a hole in said rear panel proximate the top thereof for hanging said package.

13. A package according to claim 1 including a pair of side panels, each side panel being flexibly attached to said rear panel on an opposite side of said blister portion, and in which said receiving means comprises a band formed as a part of the bottom of said carrier portion and joining said side panels so that when said receiving means is extended outwardly about said retention element said side panels are flexed to retain said blister portion therebetween.

14. A vertically elongated package suitable for hanging or standing on end, comprising a. a blister portion including a receptacle having a substantially flat, open back, a closed front and sides, and a closed bottom, b. a top flange extending upwardly from said receptacle at said back, c. a bottom flange extending downwardly from the bottom of said receptacle at said back, said bottom flange comprising a rear support for standing said package on end, d. a protrusion formed in the bottom of said receptacle and extending outwardly and downwardly therefrom, e. a carrier portion joined to said blister portion and including a flat rear panel abutting said open back, said carrier being disposed vertically and having a bottom and a top, f. a pair of side panels extending from and flexibly joined to opposite sides of said rear panel, each said side panel being adjacent one side of said blister portion, and g. means for removably mounting said blister portion upon said carrier portion, comprising i. flap means formed in said rear panel for securing thereunder said top flange to said rear panel, and ii. receiving means in the bottom of said carrier portion for engaging and holding said protrusion, said receiving means further comprising a front support for use in standing said package on end and including a band formed in the bottom of said carrier portion and connected at the ends thereof to said side panels for engagement about said protrusion and for flexing said side panels to retain said blister portion therebetween when said protrusion is so engaged, said band extending outwardly from said bottom flange beneath the bottom of said receptacle when said blister portion is mounted upon said carrier portion, iii. said flap means being situated in said rear panel such that when said blister portion is mounted on said carrier portion, said top flange is secured to said panel by said flap means and said bottom flange is situated at the bottom of said carrier portion, h. said band and said bottom flange of said blister portion in combination comprising a rest for supporting package on end on a horizontal surface.

* * * * *